US008202119B2

(12) United States Patent
Zhang

(10) Patent No.: US 8,202,119 B2
(45) Date of Patent: Jun. 19, 2012

(54) ELECTRICAL CONNECTOR HAVING SWITCHING TERMINAL

(75) Inventor: Dao-Kuan Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/939,202

(22) Filed: Nov. 4, 2010

(65) Prior Publication Data

US 2011/0104946 A1 May 5, 2011

(51) Int. Cl.
*H01R 13/648* (2006.01)

(52) U.S. Cl. ..... 439/607.23; 439/660

(58) Field of Classification Search ..... 439/660, 439/626, 89, 79, 607.23–607.5, 924.1
See application file for complete search history.

(56) References Cited

U.S. PATENT DOCUMENTS 6,296,521 B1 * 10/2001 Chang et al. ..... 439/607.4
7,329,153 B2 * 2/2008 Lin et al. ..... 439/660
2009/0111330 A1 * 4/2009 Lin et al. ..... 439/638
2009/0258514 A1 * 10/2009 He et al. ..... 439/79
2010/0112834 A1 * 5/2010 Chen et al. ..... 439/78
2010/0173529 A1 * 7/2010 He et al. ..... 439/660
2010/0248537 A1 * 9/2010 Zhou et al. ..... 439/571

FOREIGN PATENT DOCUMENTS

CN 201112877 Y 9/2008

* cited by examiner

*Primary Examiner* — Renee Luebke

*Assistant Examiner* — Larisa Tsukerman

(74) *Attorney, Agent, or Firm* — Ming Chieh Chang; Wei Te Chung; Andrew C. Cheng

(57) ABSTRACT

An electrical connector (100) includes an insulative housing (1) defining a USB port (11) including a tongue portion (12) defining four first recesses (121) receiving four first terminals and one second recess (122) for receiving one second terminal. The four first terminals and the second terminal are arranged side-by-side at a same side of the tongue portion. The second terminal includes a second contact beam having a width smaller than that of a first contact beam of the first terminal.

13 Claims, 7 Drawing Sheets

ELECTRICAL CONNECTOR HAVING SWITCHING TERMINAL

BACKGROUND OF THE INVENTION

1. Field of the Invention

The present invention relates to an electrical connector, and more particularly to a USB (Universal Serial Bus) connector including a switching terminal arranged beside four USB terminals.

2. Description of Related Art

CN Patent No. 201112877Y issued on Sep. 10, 2008 discloses a USB connector including a USB port. The USB connector comprises a tongue portion formed in the USB port and four USB terminals secured in the USB port. The tongue portion defines four terminal recesses for receiving the four USB terminals.

When it is needed to add a switching circuit in the connector, the connector fails to have any element to perform the switching function.

Hence, an electrical connector having a switching terminal and the method of making the same is highly desired.

SUMMARY OF THE INVENTION

Accordingly, an object of the present invention is to provide an electrical connector including a switching terminal arranged beside four USB terminals for performing switching function.

In order to achieve the object set forth, an electrical connector includes an insulative housing defining a USB port including a tongue portion. The tongue portion defines four first recesses and one second recess beside the four first recesses. The second recess has a width smaller than that of the first recess. The electrical connector includes four first terminals secured in the four first recesses and one second terminal secured in the second recess. The four first terminals and the second terminal are arranged side-by-side at a same side of the tongue portion. Each first terminal has a first contact beam. The second terminal has a second contact beam having a width smaller than that of the first contact beam of the first terminal.

The width of the tongue portion of the electrical connector is equal to that of the tongue portion complying to standard USB 2.0 specification. The width and the arrangement of the first terminals 21 are same to that of corresponding terminals complying to either standard USB 2.0 specification or standard USB 3.0 specification. One second terminal is added in the USB 2.0 port to configurate the preferred embodiment of the present invention. The second terminal could perform a switching function or any other functions according to the requirement. The electrical connector has an added function by adding a second terminal at the tongue portion maintaining the dimension equal to that of tongue portion complying to either standard USB 2.0 specification or standard USB 3.0 specification. Additionally, the second terminal and the first terminals are punched from a same material strip to save material and ease the method of making the electrical connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
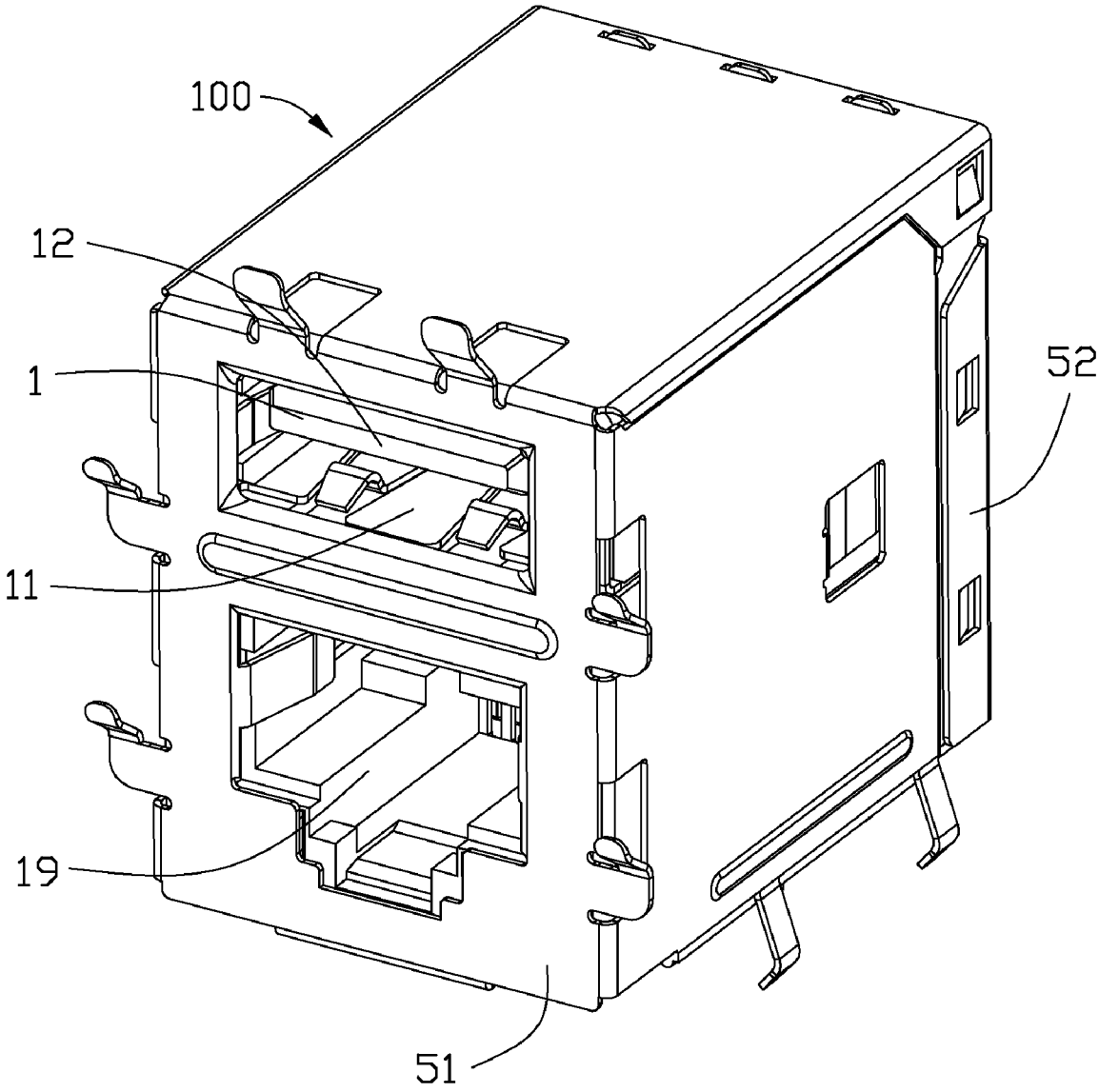
FIG. 1 is a perspective view showing an electrical connector in accordance with the present invention.

Reference will now be made in detail to the preferred embodiment of the present invention. Referring to FIGS. 1-6, an electrical connector 100 comprises an insulative housing 1 having a USB port 11 and a modular port 19 below the USB port 11, a plurality of USB terminals 2 secured in a tongue portion 12 of the USB port 11, and a contact module 3 inserted in the modular port 19, a shielding shell 4 inserted in the USB port 11, a shielding cage 51 and a shielding plate 52 attached to the insulative housing 1.

Figure 2:
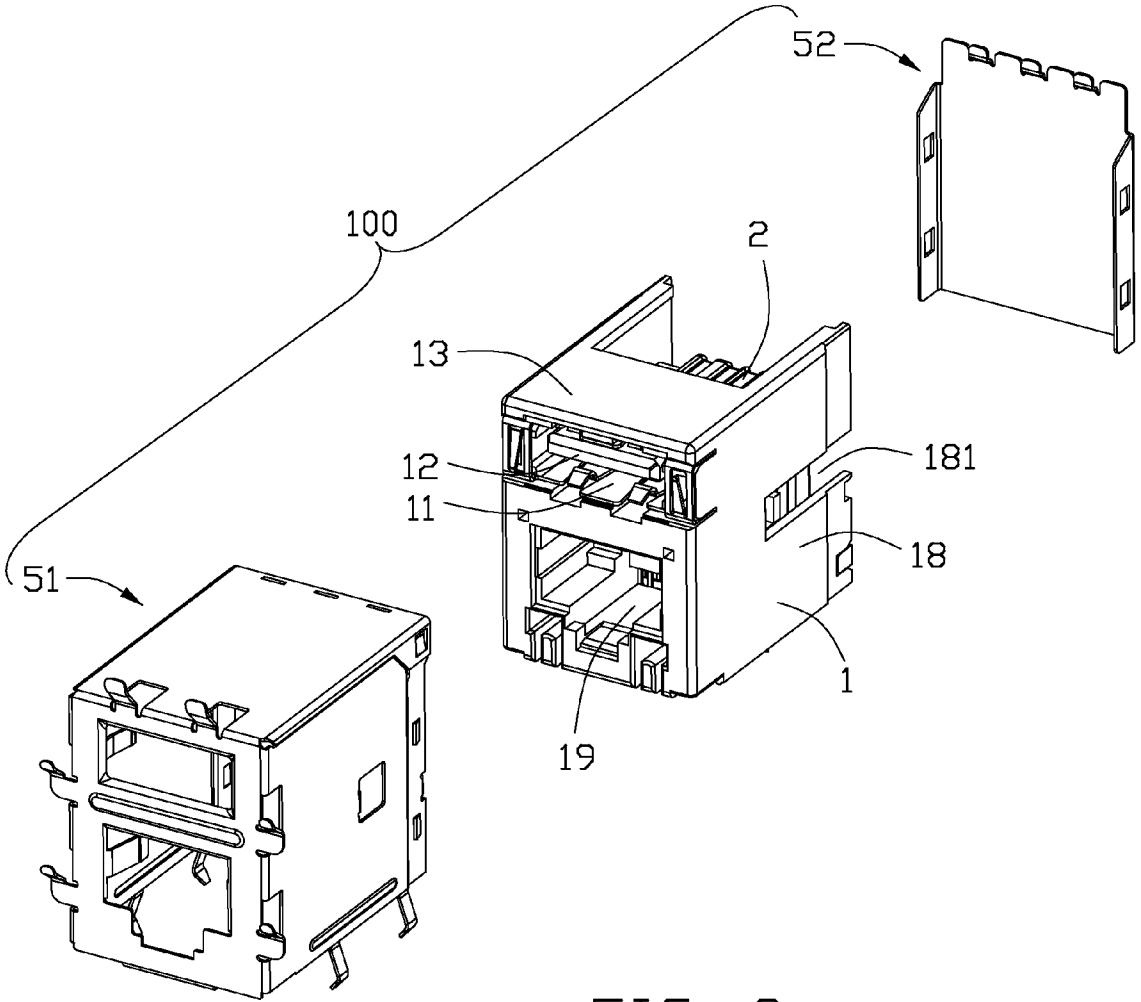
FIG. 2 is a partially exploded perspective view showing the electrical connector, with a shielding cage and a shielding plate being separated from an insulative housing.
Figure 3:
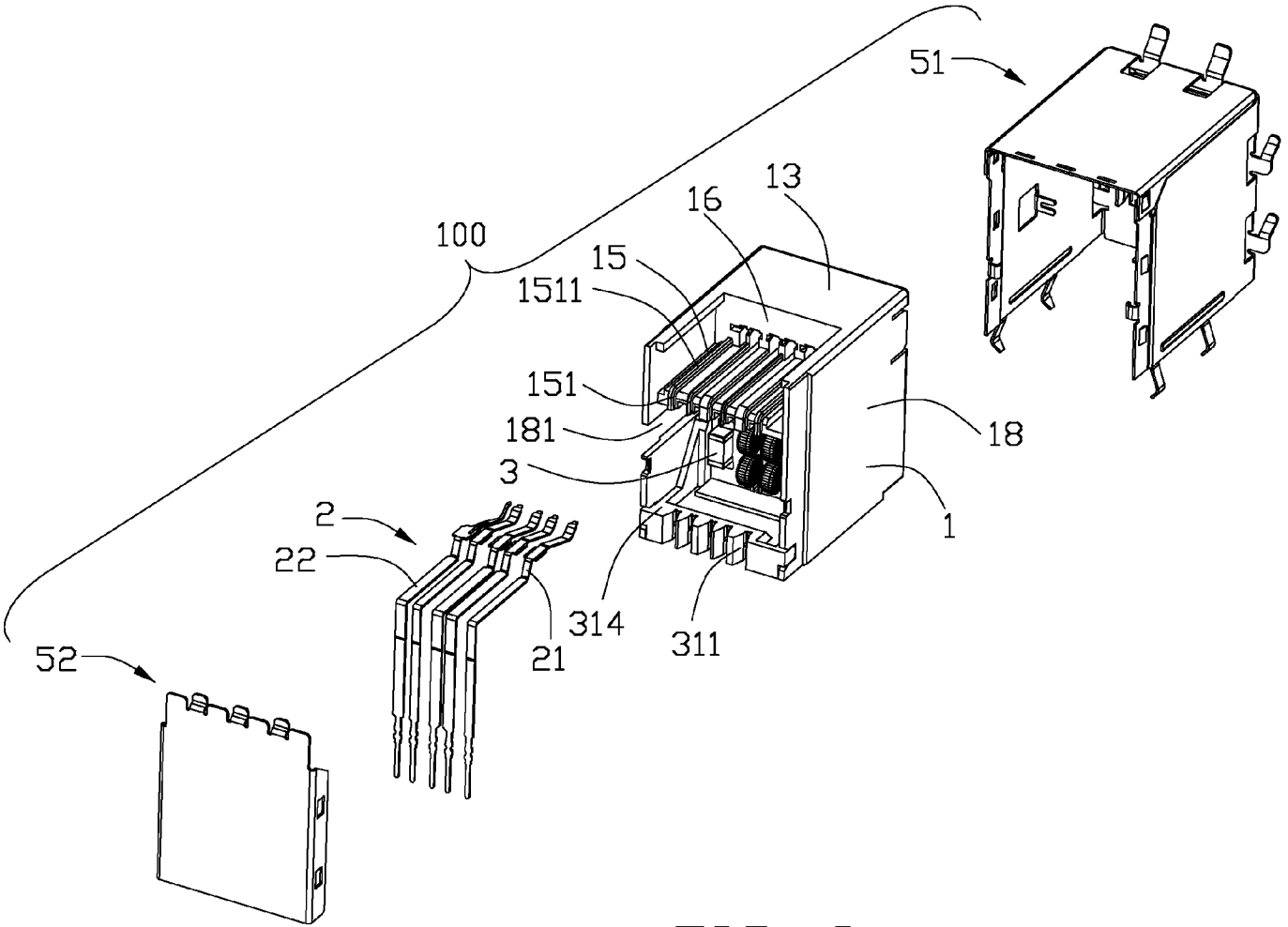
FIG. 3 is a partially exploded perspective view showing the electrical connector, with the shielding cage, the shielding plate and the USB terminals being separated from an insulative housing.
Figure 4:
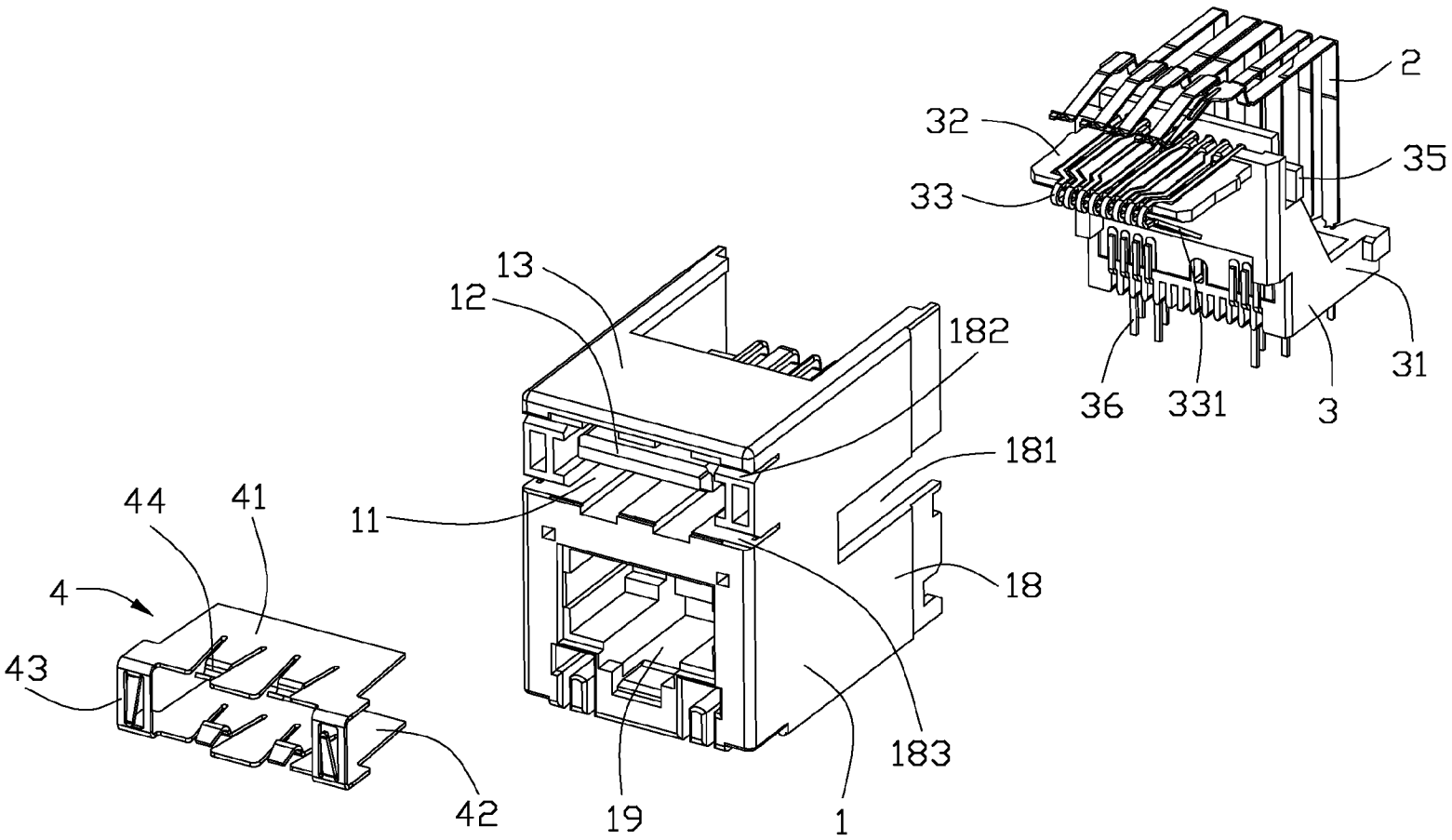
FIG. 4 is an exploded perspective view showing the contact module, the USB terminals and the shielding shell separated from the insulative housing.
Figure 5:
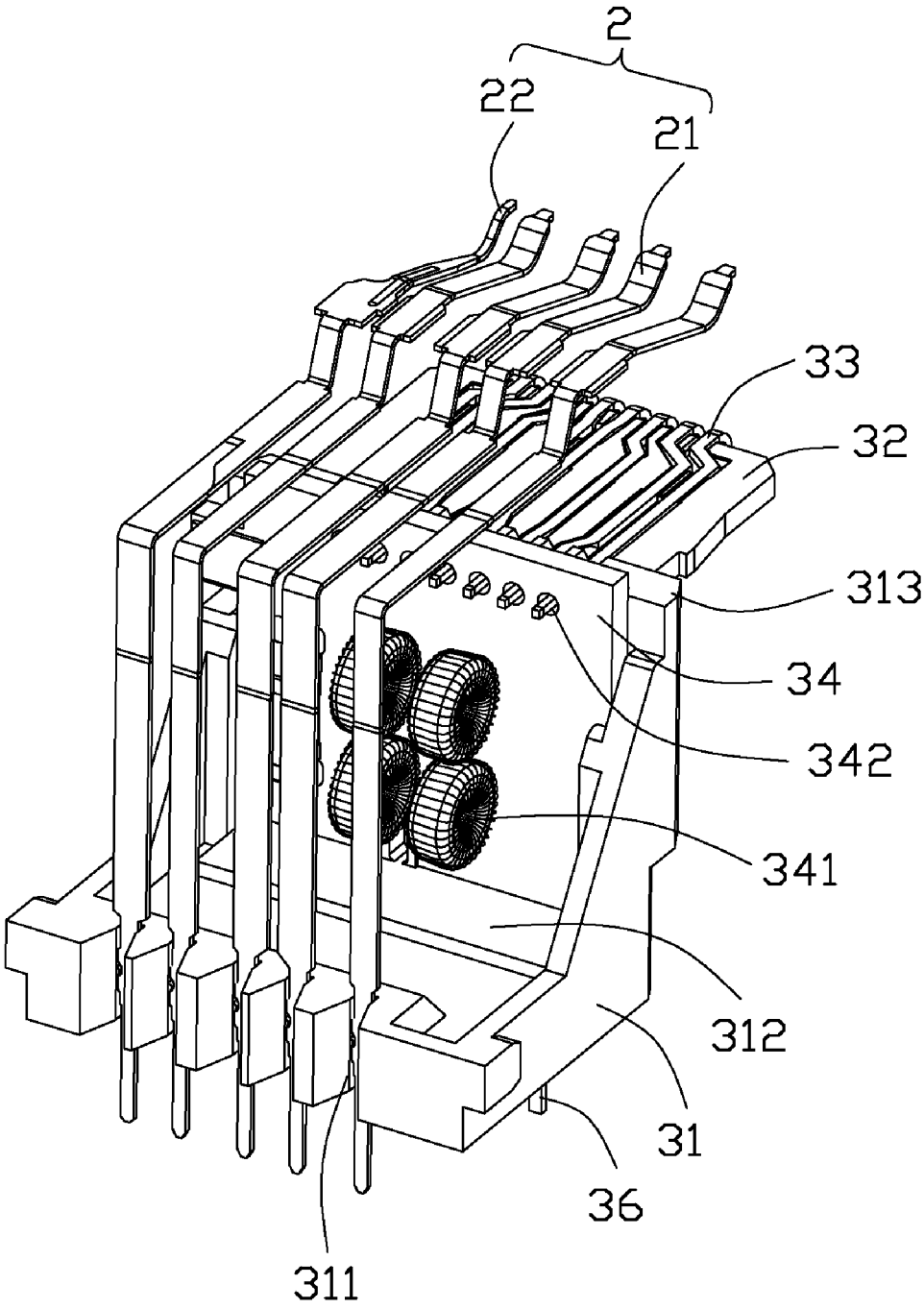
FIG. 5 is a perspective view showing the contact module and the USB terminals.

Referring to FIGS. 2-4, the insulative housing 1 comprises a top wall 13, a pair of side walls 18, a vertical inner wall 16, a supporting wall 151 parallel with the top wall 13, a concave portion 15 surrounded by the pair of side walls 18 and the inner wall 16. Each of the side walls 18 defines an upper slit 182 and a lower slit 183 adjacent to the USB port 11. One of the side walls 18 defines a guiding slot 181 at a rear portion thereof.

Figure 6:
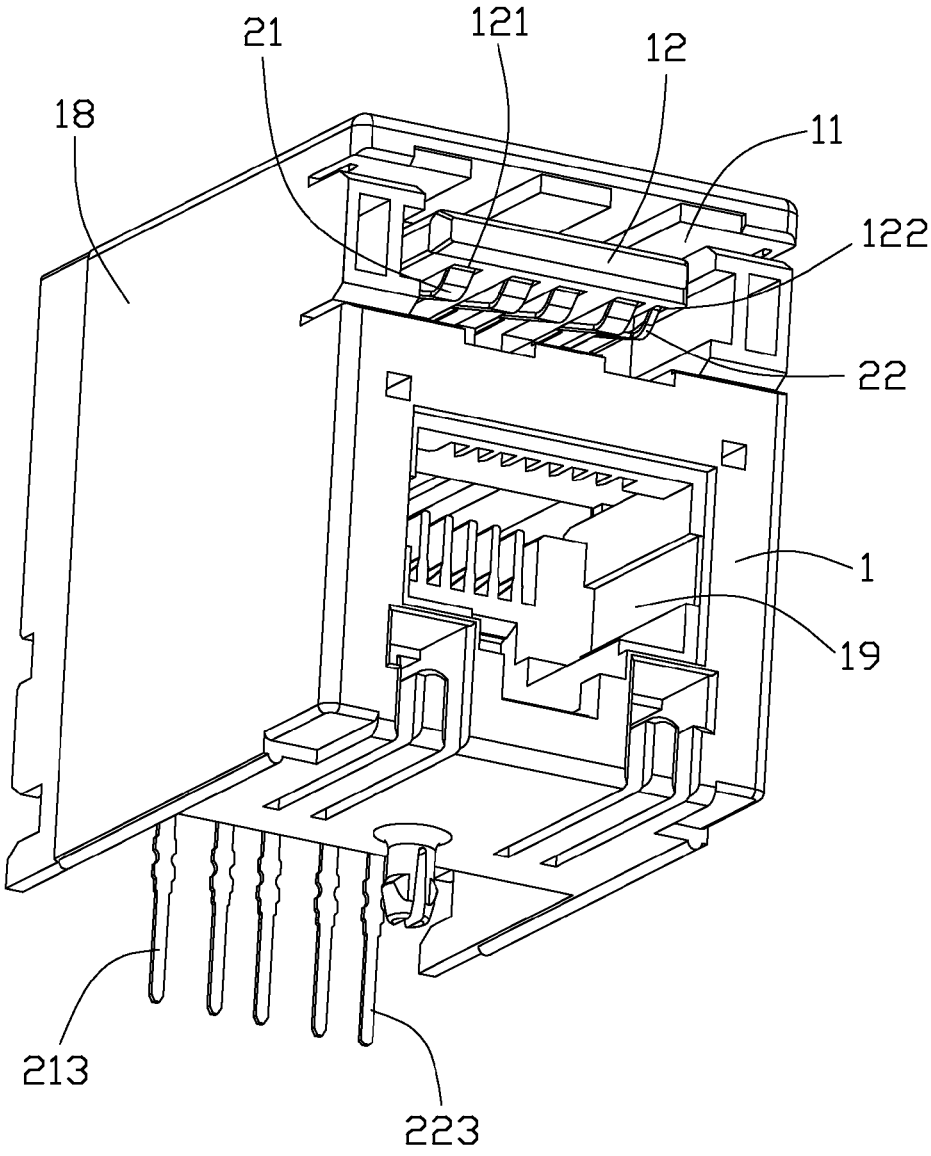
FIG. 6 is a perspective view showing the USB terminals assembled in the insulative housing.
Figure 7:
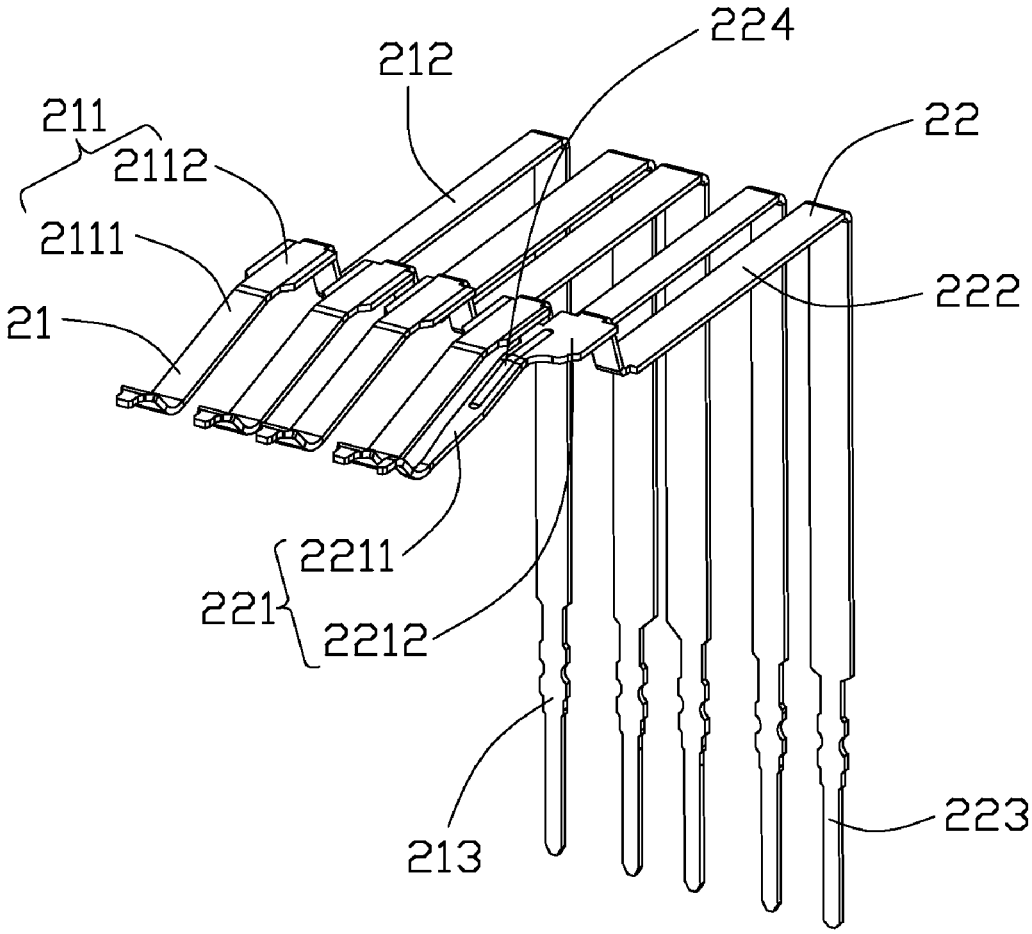
FIG. 7 is a perspective view showing the USB terminals.

In conjunction with FIG. 6, the tongue portion 12 of the insulative housing 1 has four first recesses 121 defined at a lower surface of the tongue portion 12, and a second recess 122 defined at the lower surface and beside the four first recesses 121. The second recess 122 has a width smaller than that of each first recess 121.

Referring to FIGS. 4-7, the USB terminals 2 comprise four first terminals 21 and one second terminal 22. Each first terminal 21 comprises a first conductive portion 211, a first soldering portion 213, and a first connecting portion 212 between the first conductive portion 211 and the first soldering portion 213. The first conductive portion 211 includes a first neck portion 2112 connecting with the first connecting portion 212, and a first contact beam 2111 formed at a front end of the first terminal 21.

The second terminal 22 comprises a second conductive portion 221, a second soldering portion 223, and a second connecting portion 222 between the second conductive portion 221 and the second soldering portion 223. The second conductive portion 221 includes a second neck portion 2212 connecting with the second connecting portion 222, and a second contact beam 2211 formed at a front end of the second terminal 22. The second conductive portion 221 has a width smaller than that of the first conductive portion 211. The second conductive portion 221 has a rib 224 formed thereon for strengthening the second conductive portion 221.

The contact module 3 comprises a base 31, a paddle board 34, a supporting board 32, a plurality of contact terminals 33 and converting terminals 36. The base 31 includes a bottom wall 314, a supporting wall 213 perpendicular to the bottom wall 314, and a receiving cavity 312 defined therebetween.

The bottom wall 314 of the base 31 defines a plurality of fixing slots 311. The resisting wall 313 of the base 31 is formed with a guiding portion 35. The paddle board 34 has a plurality of conductive holes 342 defined therethrough and a plurality of magnetic components 341 formed at a rear face thereof.

In assembling of the contact module 3, the paddle board 34 is vertically attached to a rear side of the resisting wall 313, and the supporting board 32 is horizontally attached to a front side of the resisting wall 313. The contact terminals 33 are supported on the supporting board 32, with free ends inserting through the conductive holes 342 of the paddle board 34. The plurality of converting terminals 36 are fixed in the base 31.

The shielding shell 4 comprises an upper plate 41, a lower plate 42, and a pair of connecting plates 43 connecting with the upper plate 41 and the lower plate 42. The upper plate 41 and the lower plate 42 are respectively formed with a plurality of resilient beams 44.

Referring to FIGS. 1-7, during making the electrical connector 100, four first terminals 21 and one second terminal 22 are punched from one material strip firstly. Each of the first terminals 21 includes a first conductive portion 211 having a first contact beam 2111 and a first neck portion 2112, a first connecting portion 212 and a first soldering portion 213. The second terminal 22 includes a second conductive portion 221 having a second contact beam 2211 and a second neck portion 2212, a second connecting portion 222 and a second soldering portion 223. The second contact beam 2211 is formed with a rib 224 thereon.

The second contact beam 2211 of the second terminal 22 is partially cut away to thereby have a width smaller than that of the first contact beam 2111 of the first terminal 21. The first terminals 21 are inserted in the first recesses 121 and the second terminal 22 are inserted in the second recess 122. The first contact beam 2111 and the second contact beam 2211 are disposed at the lower side of the tongue portion 12 and are located at a same height. The first neck portions 2112 and the second neck portion 2212 are coplanar.

The shielding shell 4 is inserted in the USB port 11 along the upper slits 182 and the lower slits 183, with the upper plate 41 and the lower plate 42 respectively flanking opposite sides of the tongue portion 12 together with the USB terminals 2.

The contact module 3 is inserted in the modular port 19, with the guiding portion 35 sliding along the guiding slot 181. The contact terminals 33 are exposed in the modular port 19. The USB terminals 2 are secured in the fixing slots 311. The shielding cage 51 and the shielding plate 52 are attached to the insulative housing 1 finally.

The width of the tongue portion 12 of the electrical connector 100 is equal to that of the tongue portion complying to either standard USB 2.0 specification or standard USB 3.0 specification. The width and the arrangement of the first terminals 21 are same to that of corresponding terminals complying to either standard USB 2.0 specification or standard USB 3.0 specification. One second terminal 22 is added in the USB 2.0 port to configurate the preferred embodiment of the present invention. The second terminal 22 could perform a switching function or any other functions according to the requirement. In another embodiment, the second terminal 22 could be formed in the standard USB 3.0 port.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a USB (Universal Serial Bus) mating port including a receiving cavity and a mating tongue horizontally extending in the cavity along a front-to-back direction;

four standard USB terminals disclosed in the mating port, each of said terminals including a mating section exposed upon the mating tongue for mating with a plug, and a mounting section behind the housing for mounting to a printed circuit board; and a control contact disposed in the housing and beside said standard USB terminals in a transverse direction perpendicular to said front-to-back direction, and defining a mating portion exposed upon the mating tongue for mating with said plug, and a mounting portion behind the housing for mounting to the printed circuit board; wherein a distance between the mating portion of the control contact and the mating section of a neighboring terminal of the four standard USB terminals is smaller than that between the mounting portion of the control contact and the mounting section of said neighboring terminal in said transverse direction.

2. The electrical connector as claimed in claim 1, wherein the terminal includes a retaining section right behind the corresponding mating section for retaining the terminal to the housing, and the control contact includes a retaining portion right behind the corresponding mating portion for retaining the control contact to the housing, under condition that the mating section and the corresponding retaining section essentially share a same centerline in the front-to-back direction while the mating portion and the corresponding retaining portion have different center lines in said front-to-back direction and are offset from each other in the transverse direction.

3. The electrical connector as claimed in claim 2, wherein said mating portion of the control contact is narrowed than the mating section of the neighboring terminal.

4. The electrical connector as claimed in claim 3, wherein the retaining portion of the control contact is essentially as wide as the retaining section of the neighboring terminal.

5. The electrical connector as claimed in claim 3, wherein a rib is formed on the mating portion and the retaining portion and extends in the front-to-back direction.

6. The electrical connector as claimed in claim 1, wherein said control contact is located between an outermost terminal and the corresponding side edge of the mating tongue.

7. The electrical connector as claimed in claim 1, further including a metallic shell assembled to the housing and having opposite upper and lower plates linked by a pair of connecting plates, wherein the upper and lower plates are inserted into the mating port while the pair of connecting plates are exposed outside of the housing.

8. The electrical connector as claimed in claim 7, wherein said mating portion of the control contact and the mating sections of the USB terminals are located at a same level along an up-to-bottom direction and in a same position along said front-to-back direction.

9. An electrical connector comprising:

an insulative housing defining a USB (Universal Serial Bus) mating port with a mating plate horizontal extending therein in a front-to-back direction;

four USB terminals disposed in the housing, each of said terminals including a mating section exposed upon the mating plate for mating with a plug, a amounting section located on a rear side of the housing for mounting to an exterior part, and a retaining section behind the mating section in said front-to-back direction for retaining the corresponding USB terminal to the housing; and at least one control contact disposed in the housing and located beside the USB terminals in a transverse direction perpendicular to said front-to-back direction, said control contact defining a mating portion exposed upon the mating plate for mating with the plug, a mounting portion located on a rear side of the housing form mounting to the exterior part, and a retaining portion behind the mating portion in said front-to-back direction for retaining to the housing; wherein all said USB terminals and said control contact are configured to be originally linked together on a same contact carrier in a side by side manner for saving material consideration, under condition that the mating portion of said control contact is essentially narrower than the mating section of the USB terminal in the transverse direction, while the retaining portion of the control contact defines a width similar to that of the retaining section of the USB terminal in the transverse direction.

10. The electrical connector as claimed in claim 9, wherein at least the mating portion of said control contact is deflectable.

11. The electrical connector as claimed in claim 9, wherein the retaining sections of said terminals and the retaining portion of the control contact are located at a same level.

12. The electrical connector as claimed in claim 9, wherein the mating sections of said terminals are deflectable.

13. The electrical connector as claimed in claim 9, wherein said mating plate is suspended in the mating port.

* * * * *